US006743064B2

(12) United States Patent
Gieseke

(10) Patent No.: US 6,743,064 B2
(45) Date of Patent: Jun. 1, 2004

(54) HIGH-SPEED PADDLE WHEEL CATAMARAN

(75) Inventor: Thomas J. Gieseke, Newport, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/241,382

(22) Filed: Sep. 11, 2002

(65) Prior Publication Data

US 2004/0048528 A1 Mar. 11, 2004

(51) Int. Cl.[7] ..... B63H 1/06
(52) U.S. Cl. ..... 440/92
(58) Field of Search ..... 440/90, 92, 93

(56) References Cited

U.S. PATENT DOCUMENTS 1,432,700 A * 10/1922 Kirsten ..... 416/111
3,170,437 A * 2/1965 Kilmer ..... 440/91
3,716,014 A * 2/1973 Laucks et al. ..... 440/93
4,473,358 A * 9/1984 Viosca, Jr. ..... 440/92

FOREIGN PATENT DOCUMENTS

DE 3014584 * 5/1979
DE 3507192 * 9/1986

* cited by examiner

*Primary Examiner*—Sherman Basinger
(74) *Attorney, Agent, or Firm*—James M. Kasischke; Michael F. Oglo; Jean-Paul A. Nasser

(57) ABSTRACT

A high speed paddle wheel catamaran includes a hull configuration having a main hull portion with at least one defined cavity area in a lower surface of the main hull and opposing side pontoons depending from the main hull portion. The depending side pontoons correspond in orientation to a longitudinal axis of the catamaran. A paddle wheel assembly for the vessel includes a rotatable cage hub mounted on each pontoon. A plurality of vane members are rotatably mounted between the opposing cage hubs and adjacent an outer perimeter thereof. Each vane member is selectively rotated to one of a lift or thrust position according to an arcuate location of the vane as it passes through the water.

14 Claims, 4 Drawing Sheets

HIGH-SPEED PADDLE WHEEL CATAMARAN

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

This invention generally relates to a high speed paddle wheel vessel.

More particularly, the invention relates to a high speed paddle wheel vessel having a specialized paddle arrangement to generate both lift and thrust for the vessel.

2. Description of the Prior Art

Very high-speed ship operations are a current interest of the U.S. Navy. There is a desire by the U.S. military to provide a high-speed ocean transport capable of operating over very large distances at speeds in excess of 100 knots. In order to achieve this high-speed operation over large distances, a means of ship drag reduction is necessary. One suitable method is to utilize high-speed supercavitating hydrofoils to lift the ship out of the water. If the foils are properly designed, the total drag of the foils will be significantly less than the ship would experience if driven at the same speed while fully wetted. There are two difficulties with a hydrofoil ship addressed by the current invention. First, a large power plant is required to drive the wetted vessel up to a speed at which it can be elevated out of the water by its hydrofoils. The power required to achieve effective hydrofoil operation is significantly higher than that required to maintain a cruise speed while using the hydrofoils. Second, a propulsion system is needed, which will operate effectively at very high ship speeds.

The following patents, for example, disclose paddle wheel vessels, but do not disclose a high speed paddle wheel catamaran having specialized paddle wheels for generating lift and thrust for the vessel.

U.S. Pat. No. 5,427,554 to Foglia;

U.S. Pat. No. 5,845,593 to Birkestrand;

U.S. Pat. No. 5,988,092 to Price; and

U.S. Pat. No. 6,083,062 to Trecloar et al.

Specifically, Foglia discloses a recreational water craft adaptive to be manually powered by one or more crew members or readily converted form manual power to sail (or supplement by sail) without loss of stability or increase in complexity of operation. This water craft possessed the attributes of a tri-hull and/or catamaran vessel, wherein the crew is supported and operates such vessel from a centrally located platform or main float which is connected to, and flanked on either side by, an outrigger float or pontoon. Each outrigger float is further provided with a vertical extension or riser to which is mounted and independently operated and manually powered paddle wheel. The paddle wheels, upon mounting to the riser, are positioned in the open wells located to the port and starboard sides of the platform and inboard of each of the outrigger floats. The paddle wheels each have a handle or hand grip on their inboard surface, which can be adjusted relative to the axis of rotation of each of such wheel, to accommodate the crew member's reach and his location on the main float, and thereby modulate the amount of force, and physical exertion, required to rotate the paddle wheel. Insofar as each of the paddle wheels is independently driven, the water craft's directional movement (steering) is determined by the relative amount of thrust created by rotation of either paddle wheel or by the counter-rotation of each such paddle wheel relative to one another.

The patent to Birkstrand discloses a non sinkable, easily re-rightable aquatic vehicle having a lightweight body with a front, a rear, a bottom and opposite sides and contains a seat for supporting a pilot. A pair of front sheaves are rotatably mounted to opposite sides of the body near the front of the body and a pair of rear sheaves are rotatably mounted to opposite sides of the body near the rear thereof. A first flotation track is engaged around and extends between the front and rear sheaves on one side of the body and a second flotation track is engaged around and extends between the front and rear sheaves on the other side of the body. Each said floatation track includes an endless band engaged around a front and rear sheave and a multiplicity of buoyant flotation treads connected to the band at spaced apart locations therealong to form upper and lower series of flotation treads extending between the associated front and rear sheaves. A pedal drive is mounted to the body for producing an output torque which is coupled to at least one of the sheaves on each side of said body so as to advance the tracks in order to propel the vehicle and brakes are provided to steer and stop the vehicle. A mast and sail may also be mounted to the body in such a way that the mast can be tilted in any direction and rotated about its axis to operate the vehicle under sail with maximum ease and efficiency.

Price discloses a paddle wheel boat having a relatively uniform weight distribution throughout the length of the vessel that maintains a level trim under all operation conditions thereby maximizing the efficiency of the design and operation. This is, in part, accomplished by locating the engine and major transmission drive components inboard of the boat rather than outboard astern, and by location the operation and the rudder assembly at the bow of the boat. Unique features of the invention include the propulsion and steering systems for a boat consisting of a paddle wheel, a frame to attach the propulsion members to the boat and a rudder assembly mounted to the bow of the boat. The paddle wheel can include blades to effect vertical lift secured to angled spokes at an angle radially, inclined or skewed to the axis of rotation of the paddle wheel rather than extending radially from the axis of rotation of the center hubs. The steering system includes the rudder assembly mounted at the bow of the boat and being formed and arranged to pivot freely about a horizontal axis in a vertical direction as well as having a rudder blade which pivots about a vertical axis.

Treloar et al. discloses a lightweight, collapsible boat comprising twin parallel hulls, a frame and human-powered paddlewheels outboard of the two hulls. The boat's frame is capable of being collapsed and packed into a bundle for carrying as a backpack. The drive comprises a pedal drive for turning a short drive axle that is independently and releasably coupled to paddlewheel driveshafts. The boat is steered by selective engaging and disengaging of the left and right couplings. The frame comprises a steering column, an operator's seat support, rear hull spacing members and front hull spacing members that support the driveshafts. The couplings can be fully disengaged for releasing the driveshafts and permitting the front spacing members and driveshafts to pivot at the bottom of the steering column.

It should be understood that the present invention would in fact enhance the functionality of the above patents by providing individually rotatable hydrofoil type vanes at an outer edges of rotating cage hubs, thereby defining a unique paddle wheel cage.

SUMMARY OF THE INVENTION

Therefore it is an object of this invention to provide a propulsion system for a surface vessel.

Another object of this invention is to provide a propulsion system producing both lift and thrust. Still another object of this invention is to provide a propulsion system useful with a catamaran type surface vessel.

Accordingly, there is provided a paddle wheel propulsion system having a hull configuration with a main hull portion, at least one defined cavity area in a lower surface of the main hull, and opposing side pontoons depending from the main hull portion. The depending side pontoons correspond in orientation to a longitudinal axis of the catamaran. A paddle wheel assembly for the vessel includes a rotatable cage hub mounted on each pontoon and a plurality of vane members rotatably mounted between the opposing vane hubs and adjacent an outer perimeter thereof. Each vane member is selectively rotated to one of a lift or thrust position according to an arcuate position thereof as it passes through the water.

In accordance with another aspect of the invention, there is provided a catamaran vessel having a paddle wheel propulsion system having a hull configuration with a main hull portion, at least one defined cavity area in a lower surface of the main hull, and opposing side pontoons depending from the main hull portion. The depending side pontoons correspond in orientation to a longitudinal axis of the catamaran. A paddle wheel assembly for the vessel includes a rotatable cage hub mounted on each pontoon and a plurality of vane members rotatably mounted between the opposing vane hubs and adjacent an outer perimeter thereof. Each vane member is selectively rotated to one of a lift or thrust position according to an arcuate position thereof as it passes through the water.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENTS

In general, the present invention is directed to a device for surface ship propulsion and simultaneous drag reduction by utilizing a specialized paddle-wheel to provide forward thrust and lift. The lift force elevates the vessel partially out of the water, thus reducing wetted surface area, displacement, and ship drag.

Figure 1:
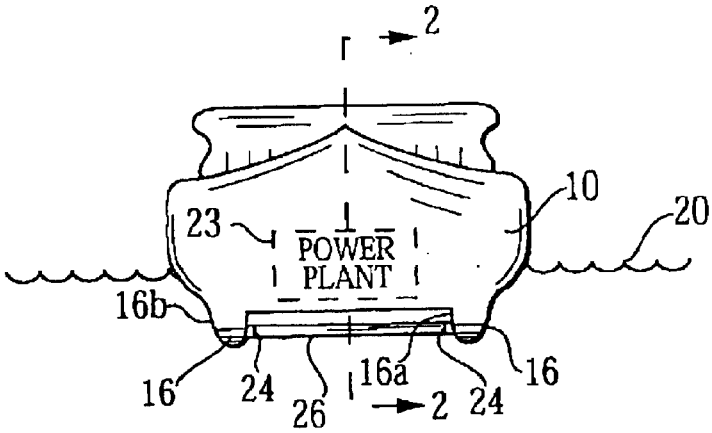
FIG. 1 is an end view of a vessel according to a preferred embodiment of the present invention.
Figure 2:
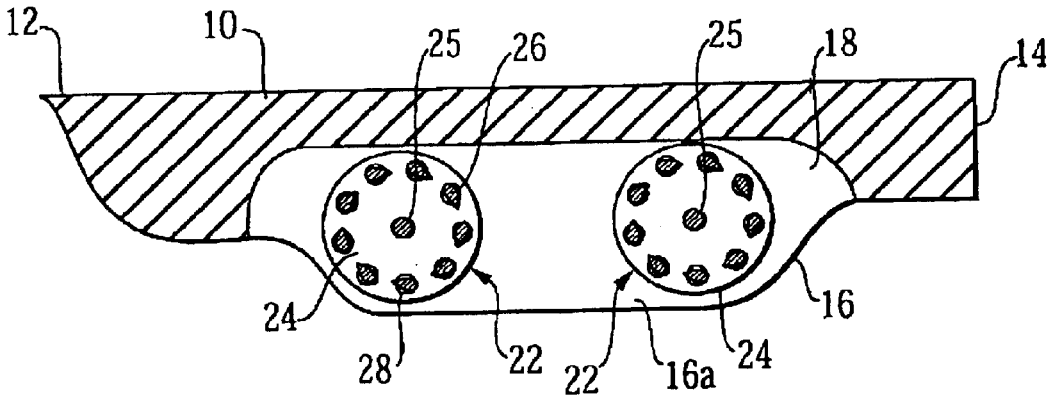
FIG. 2 is side sectional view taken along line 2—2 of FIG. 1 of the present invention.

Referring first to FIG. 1 of the present invention, there is shown an end view of a surface vessel according to a preferred embodiment of the present invention. The surface vessel includes a main hull 10 having a fore end 12 and an aft end 14. The main hull 10 includes a pair of low drag pontoon supports 16 on opposing sides of and depending from the main hull 10. The pontoon supports 16 each have an inner face 16*a* and an outer face 16*b* and are aligned with a longitudinal axis of the vessel and extend a predetermined length of the surface vessel as shown in FIG. 2 to support the vessel. Essentially, the main hull 10 is a displacement hull straddling the two pontoons 16 of the catamaran ship such that the displacement hull can support the vessel when the paddle-wheel cages are not in operation.

An underside of the main hull 10 is recessed at 18 and with the depending pontoon supports 16 forms a cavity beneath the main hull 10. When the surface vessel is stationary, it seats in water 20 at a level of the main hull 10 above the pontoon supports 16 as shown in FIG. 1. When the paddle wheel begins to rotate, the wetted portion of the hull 10 is lifted out of the water and only the very narrow portion of the pontoons 16 are left below the water surface 20.

As shown in FIG. 1 and in more detail in FIG. 2, the cavity beneath the main hull 18 houses at least a pair of cylindrical paddle-wheel cages 22. Each paddle wheel cage 22 includes a pair of cage hubs 24 each rotatably mounted at a central axis 25 thereof to inner opposing faces 16*a* of the pontoon supports 16. The central axis 25 of the paddle wheel cage 22 is perpendicular to the longitudinal axis of the main hull 10 and the cage hubs 24 are coplanar with each other and parallel to the longitudinal axis of the main hull 10. The hubs 24 are driven by the ship's power plant 23 through an arbitrary drive train (not shown).

A characteristic feature of the paddle wheel cage 22 is the placement of a plurality of individually rotatable vane members 26 adjacent an outer perimeter of the cage hubs 24. The combination of the hubs 24 spanned by the plurality of vane members 26 is what defines the structure of the paddle wheel cage 22. Although not shown, it would be possible to position an axle or the like to connect the opposing cage hubs 24 together. Each vane member 26 has a pair of opposing vane hubs 28 rotatably mounted to an inner surface of the cage hubs 24. The opposing vane hubs 28 are aligned to avoid torque of the vane member 26 spanning the two vane hubs. Further, each vane member 26 rotates about an axis defined by its opposing vane hubs 28 for individual adjustment with respect to a position of the vane member 26 in or out of the water 20. More specifically, each vane member 26 is shaped as a low-drag high-lift hydrofoil that can be rotated to change the angle of attack and lift generated by each of the hydrofoils. The vane members 26 may either be conventional hydrofoils or super-cavitating foils. Super-cavitating foils offer the advantage of operating effectively at a low cavitation number and are not influenced by the ventilated cavity generated when the vane 26 plunges into the water 20 from the air.

Figure 3:
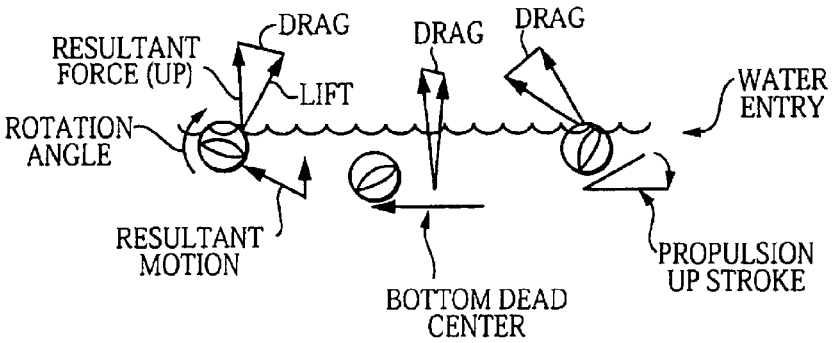
FIG. 3 is a schematic diagram of relative force and lift according to the present invention.

As shown more clearly in the lift and drag force vector diagrams of FIG. 3, the vane members 26 are of a teardrop cross-sectional shape. When oriented in a predetermined manner, each of the vane members 26 will individually impart a lift and/or a thrust motion to the surface vessel as the vane passes through the water 20. For example, at a point of entry into the water 20, the vane 26 is oriented to impart a lift in the direction shown, a resultant (forward) motion in the direction shown. At the initial lift, or entry of the vane 26 into the water, the forward thrust is at a minimum and the primary motion of the vessel is therefore in an upward direction. As the vane 26 reaches the bottom dead center of its passage through the water 20, the resultant motion is completely forward as shown. As the vane enters an upward propulsion stroke at an exit from the water 20, forward thrust is at a maximum.

Figure 4:
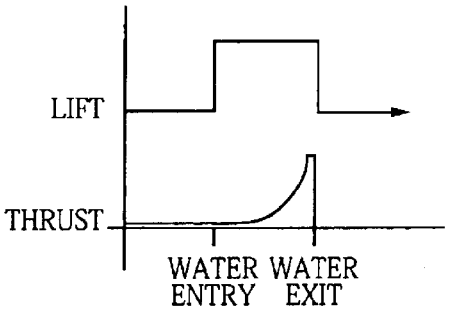
FIG. 4 is a graph comparing lift and thrust according to the present invention.

In the graph of FIG. 4, the relationship of lift to thrust is shown for a single vane blade 26. Since lift will be maintained throughout the passage of the vane through the water, the rotation angle of the vane will be adjusted to maximize thrust throughout the travel.

The basic system operation is as follows. At rest, the vessel rides low in the water, with the wetted hull 10 providing buoyant support of the vessel and payload. Less than half of the rotating cages 22 are immersed in the water 20 under this condition. Upon start-up, the cages 22 (via the cage hubs 24) begin to rotate. The hydrofoils 26 successively plunge through the water free surface, pass through the water 20 and then exit the water and rotate around until they enter the water again. The rotation of the blades 26 is continually adjusted such that lift and thrust are maximized. The lift produced by the blades 26 elevates the wetted hull 10 out of the water and the thrust accelerates the vessel to cruise speed.

During the initial portion of travel of the hydrofoil blade 26 through the water, it is not possible to generate a significant thrust while producing lift. Consequently, the blade rotation is adjusted to maximize lift, appreciating that very little thrust will be achieved. However as the blade 26 moves from bottom dead center back up toward the surface, the lift vector can be effectively directed to produce a significant thrust force. During this phase of rotation, the blade angle of attack is adjusted to maximize the thrust produced by the hydrofoil 26.

The unsteady nature of the lift and drag produced by the cage system will produce large vibration forces. Multiple cages and multiple blades are used to provide an averaging effect, resulting in a quasi-steady lift and drag force. The lift force can be generated as zero ship speed, thus reducing the power plant requirements to overcome the power "hump".

Figure 5:
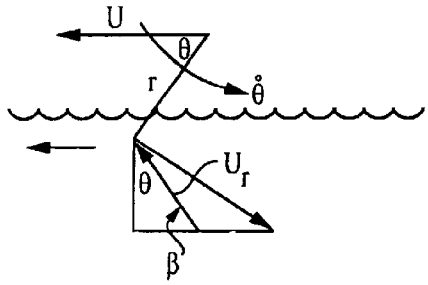
FIG. 5 is a schematic diagram of relative geometries of the present invention.

The diagram of FIG. 5 illustrates quantities used in determining both lift and forward motion for the present invention. Expressions for the quantities shown in FIG. 5 are as follows:

$$U_r=(\dot{\Theta}r\sin\Theta-U)\hat{i}+\dot{\Theta}r\cos\Theta\hat{j} \tag{1}$$

$$\beta=\arctan\left(\frac{\dot{\Theta}r\cos\Theta}{\dot{\Theta}r\sin\Theta-\Theta}\right) \tag{2}$$

$$\|U_r\|=\sqrt{\left(\dot{\Theta}r\cos\Theta\right)^2+\left(\dot{\Theta}r\sin\Theta-U\right)^2} \tag{3}$$

$$F_1=\frac{1}{2}\rho C_L(RW)U_r^2\left(-\sin\beta\hat{i}+\cos\beta\hat{j}\right) \tag{4}$$

$$F_d=\frac{1}{2}\rho C_P(RW)U_r^2\left(\cos\beta\hat{i}+\sin\beta\hat{j}\right) \tag{5}$$

Where the following definitions apply:

$U_r$=flow velocity vector $\dot{\Theta}$=hub rotation velocity

U=ship's speed

β=angle of attack

Θ=rotational angle of hub $F_l$=lift force $F_d$=drag force

R=blade chord

W=blade width $C_L$=lift coefficient $C_P$=drag coefficient

The flow velocity vector observed by the blade as it passes through the water is given by $U_r$. In the x direction, this velocity is the difference between the ship speed and the horizontal component of the hub rotation velocity. If the speed of the hub is substantially faster than the ship velocity and the blade only dips in the water at the bottom of its circular path, this component of velocity is always opposite in direction to the direction of motion of the ship and the angle beta is then always bounded between −90 and 90 degrees. The forces on the blade $F_l$ and $F_d$ are directed with respect to beta and scale with square of the resultant velocity, the blade chord R, width W, and lift and drag coefficients. The drag coefficient is always positive and the lift coefficient can be either positive or negative depending on the adjustments in the angle of attack. The ratio of lift and drag coefficient is a function of angle of attack. During the down-stroke, the angle of attack is varied so that the sum of horizontal components of force (thrust) is positive and the sum of vertical components of force (lift) is maximized. When beta changes sign and the blade begins its upstroke, thrust is maximized while requiring that lift is positive.

Figure 6A:
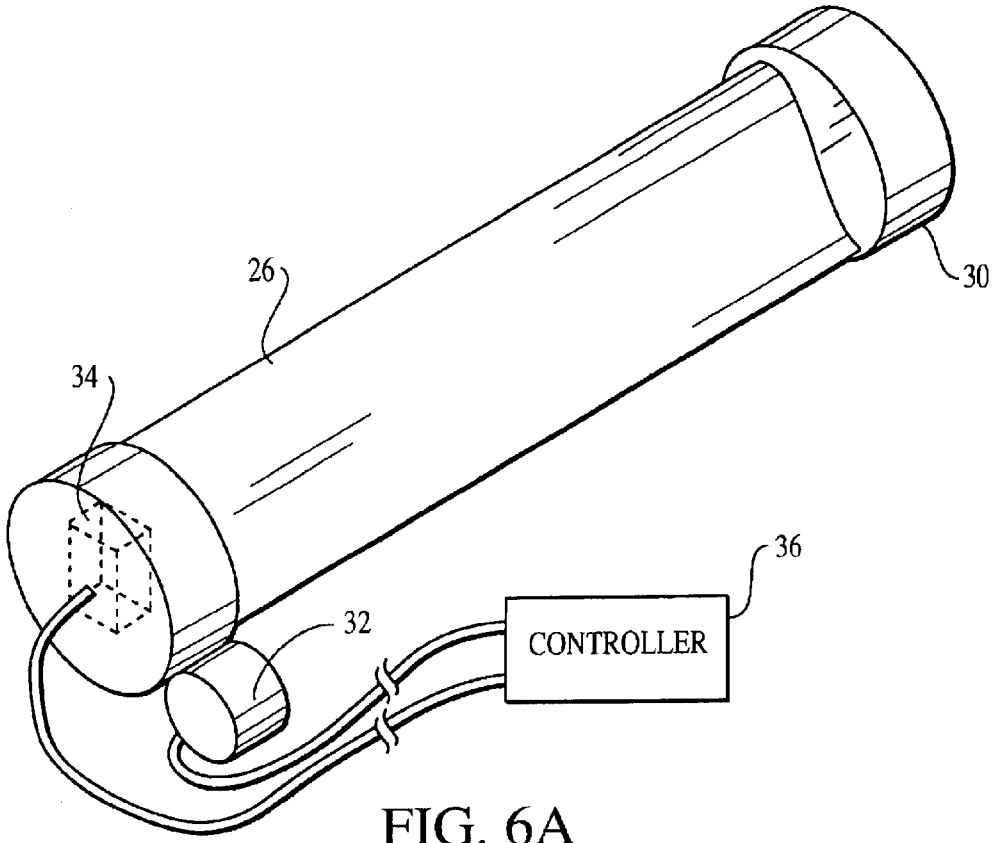
FIG. 6A is a perspective view of a first preferred embodiment implementing blade rotation for the present invention.

Rotation of blades 26 can be implemented in any way known in the art. One preferred embodiment is provided herein which includes servo motor actuation of the blades. In a closed loop embodiment, FIG. 6A, the blade 26 is axially joined to a pivoting bearing 30 to allow pivoting between bearing 30 and hub 24 and is further joined to a servo motor 32. A two axis load cell 34 is positioned on each blade 26 for measuring lift and drag on the blade 26. The servo motor 32 and load cell 34 are electrically joined through a coupling at the center 25 of the hub 24 to a controller 36. The controller 36 can control positioning of the blades 26 based on user commands or by a performance algorithm using feedback from the load cell 34. An open loop embodiment can be constructed wherein the controller 36 receives a position signal from the hub 24 and controls positioning of the blades 26 based on the hub's angular position.

Figure 6B:
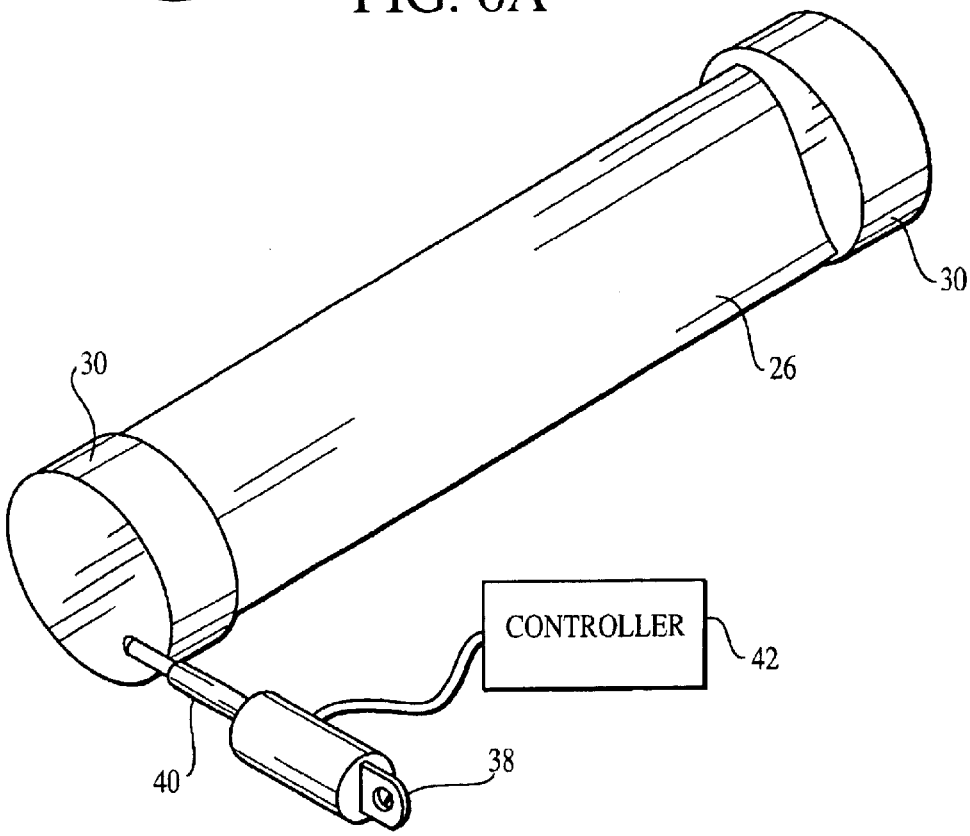
FIG. 6B is a perspective view of a second preferred embodiment implementing blade rotation for the present invention.

In another embodiment using a solenoid 38, FIG. 6B, each blade 26 is joined axially to a pivoting bearing 30. A linear solenoid 38 having a piston member 40 is linked to the bearing 30 and to the hub 24 so that extension or retraction of the solenoid piston member 40 causes rotation of the pivoting bearing 30 and the blade 26 relative to the hub 24. Again, each solenoid 38 can be electrically joined through a coupling at the center of the hub to a controller 42.

Figure 6C:
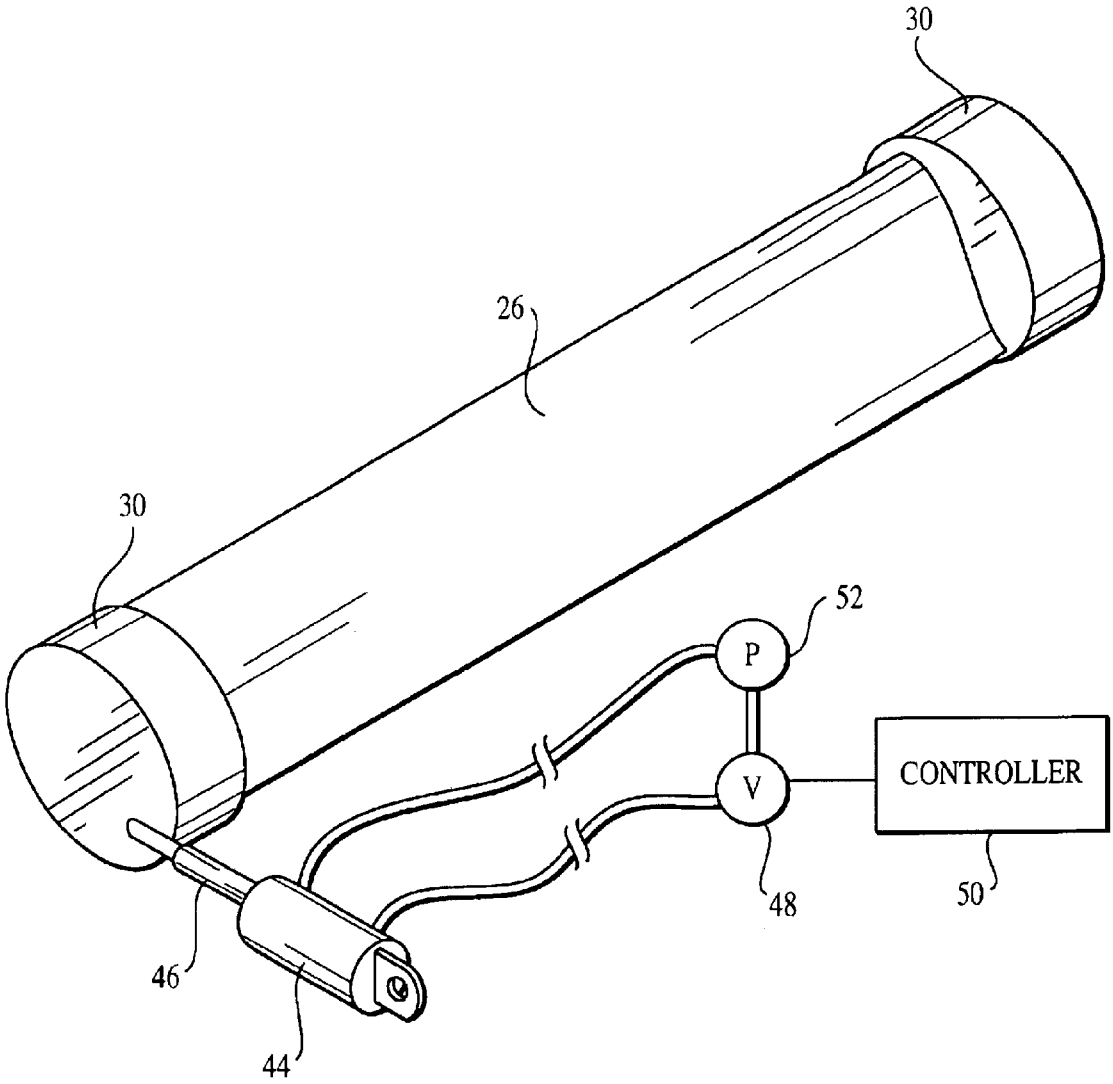
FIG. 6C is a perspective view of a third preferred embodiment for implementing blade rotation according to the present invention.

In an embodiment using hydraulic actuation, FIG. 6C, each blade 26 is again joined axially to a pivoting bearing 30. A hydraulic actuator 44 having a piston member 46 is linked to the pivoting bearing 30 and to the hub 24 so that extension or retraction of the actuator piston member 46 causes rotation of the pivoting bearing 30 and the blade 26 relative to the hub 24. A valve 48 is hydraulically joined to the hydraulic actuator 44. The valve 48 can be an electrically controlled valve associated solely with one hydraulic actuator 44, a mechanically operated manifold valve joined to all the hydraulic actuators 44, or an electrically operated manifold valve joined to all the hydraulic actuators 44. These embodiments are collectively shown by controller 50. A pump 52 is joined to the valve 48 to provide hydraulic fluid thereto. As above this embodiment could be fitted with a load cell sensor joined to the controller.

Finally, it should be understood that the system presented herein is easily be configured in other ways. For example, alternative cage configurations are possible with cages supported at one end only and appended, similar to a wheel, to the outside of a ship hull. Further, the cages may be supported on struts so that once adequate lift is achieved the vessel can continue to be lifted a safe distance from the water surface.

In view of the above detailed description, it is anticipated that the invention herein will have far reaching applications other than those described herein.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. A propulsion and lift assembly for a vessel comprising:

a first hub having a first hub center;

a second hub having a second hub center;

a plurality of vane members, each vane being rotatably mounted to said first hub and said second hub for rotating with respect to said first hub and second hub; and a rotating means joined between each vane member and at least one of said first and second hubs for independently orienting each said vane with respect to remaining ones of said plurality of vanes to provide selectable amounts of lift and thrust;

wherein said rotating means comprises:

a servo motor joined between said vane member and one of said first and second hubs; and a controller electrically connected to said servo motor.

2. The device of claim 1 further comprising a load cell joined to said vane member and detecting lift and drag forces on said vane member, said load cell being further joined to said controller.

3. The device of claim 1 wherein the controller rotates the vane member to maximize thrust throughout rotation of said first hub and said second hub.

4. The device of claim 1 wherein the controller rotates the vane member in a profile selected as based on vessel speed.

5. A propulsion and lift assembly for a vessel comprising:

a first hub having a first hub center;

a second hub having a second hub center;

a plurality of vane members, each vane being rotatably mounted to said first hub and said second hub for rotating with respect to said first hub and second hub; and a rotating means joined between each vane member and at least one of said first and second hubs for independently orienting each said vane with respect to remaining ones of said plurality of vanes to provide selectable amounts of lift and thrust;

wherein said rotating means comprises:

a hydraulic actuator joined between said vane member and one of said first and second hubs;

a valve hydraulically connected to said hydraulic actuator;

a controller joined to said valve; and a pump hydraulically joined to said valve.

6. A vessel comprising:

a catamaran hull having a superstructure and first and second depending hull members;

a power plant positioned in said catamaran hull;

a first hub having a first hub center mounted on said first depending hull member;

a second hub having a second hub center mounted on said second depending hull member, at least one of said first and second hubs being joined to said power plant;

a plurality of vane members each vane being rotatably mounted to said first hub and said second hub for rotating with respect to said first hub and second hub; and a rotating means joined between each vane member and at least one of said first and second hubs for independently orienting each said vane with respect to remaining ones of said plurality of vanes to provide selectable amounts of lift and thrust.

7. The device of claim 6 further comprising an axle joined to said first hub center and said second hub center.

8. The device of claim 6 wherein each vane has a hydrodynamic shape for maximizing force transferred and minimizing drag.

9. The device of claim 6 wherein said rotating means comprises:

a servo motor joined between said vane member and one of said first and second hubs; and a controller electrically connected to said servo motor.

10. The device of claim 9 further comprising a load cell joined to said vane member and detecting lift and drag forces on said vane member, said load cell being further joined to said controller.

11. The device of claim 9 wherein the controller rotates the vane member to maximize thrust throughout rotation of said first hub and said second hub.

12. The device of claim 9 wherein the controller rotates the vane member in a profile selected as based on vessel speed.

13. The device of claim 6 wherein said rotating means comprises:

a solenoid joined between said vane member and one of said first and second hubs; and a controller electrically connected to said solenoid.

14. The device of claim 6 wherein said rotating means comprises:

a hydraulic actuator joined between said vane member and one of said first and second hubs;

a valve hydraulically connected to said hydraulic actuator;

a controller joined to said valve; and a pump hydraulically joined to said valve.

* * * * *